US010635036B2

(12) United States Patent
Oomoto

(10) Patent No.: US 10,635,036 B2
(45) Date of Patent: Apr. 28, 2020

(54) FIXING DEVICE AND IMAGE FORMING APPARATUS PROVIDING ADJUSTABLE GLOSS TO TONER IMAGE

(71) Applicant: Konica Minolta, Inc., Tokyo (JP)

(72) Inventor: Noboru Oomoto, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/425,258

(22) Filed: May 29, 2019

(65) Prior Publication Data

US 2020/0012219 A1 Jan. 9, 2020

(30) Foreign Application Priority Data

Jul. 9, 2018 (JP) ..... 2018-129870

(51) Int. Cl.
*G03G 15/20* (2006.01)

(52) U.S. Cl.
CPC ..... *G03G 15/2064* (2013.01)

(58) Field of Classification Search
CPC ..... G03G 15/2064; G03G 2215/2038; G03G 15/2028; G03G 15/6585
See application file for complete search history.

(56) References Cited

U.S. PATENT DOCUMENTS

2006/0127142 A1* 6/2006 Nakamoto ..... G03G 15/2053 399/329
2012/0141174 A1* 6/2012 Kurita ..... G03G 15/161 399/329

FOREIGN PATENT DOCUMENTS

JP 2004184476 A 7/2004
JP 2007328046 A 12/2007

* cited by examiner

*Primary Examiner* — G. M. A Hyder
(74) *Attorney, Agent, or Firm* — Lucas & Mercanti, LLP

(57) ABSTRACT

A fixing device for fixing a toner image on a paper sheet by conveying the paper sheet on which the toner image has been formed while holding the paper sheet at a fixing nip, the fixing device includes an endless belt that rotates, a pressing member that presses the belt from the inner side, a pressure member that forms the fixing nip between the pressure member and the belt by pressing, from the outer side of the belt, a portion of the belt pressed by the pressing member, and a hardware processor that controls glossiness of the toner image formed on the paper sheet by changing a shear force to be applied to the toner image formed on the paper sheet within a predetermined range from a nip inlet that is an end of the fixing nip, located upstream in a direction in which the paper sheet is conveyed.

13 Claims, 11 Drawing Sheets

FIXING DEVICE AND IMAGE FORMING APPARATUS PROVIDING ADJUSTABLE GLOSS TO TONER IMAGE

The entire disclosure of Japanese patent Application No. 2018-129870, filed on Jul. 9, 2018, is incorporated herein by reference in its entirety.

BACKGROUND

Technological Field

The present invention relates to a fixing device and an image forming apparatus. More particularly, the present invention relates to a fixing device and an image forming apparatus capable of effectively controlling the glossiness of an image while preventing an influence on fixing performance.

Description of the Related Art

Examples of an electrophotographic image forming apparatus include a multifunction peripheral (MFP) having a scanner function, a facsimile function, a copying function, a function as a printer, a data communication function, and a server function, a facsimile machine, a copying machine, and a printer.

In general, an image forming apparatus forms an image on a recording medium by causing a developing device to develop an electrostatic latent image formed on an image carrier to form a toner image, and causing a fixing device to fix the toner image on the recording medium after the toner image is transferred to the recording medium.

Among fixing devices, there is a fixing device that includes an endless belt that rotates, a pressing member that presses the belt from the inner side of the belt, and a pressure member that presses the belt from the outer side of the belt to form a fixing nip between itself and the belt.

There is a demand for images having various glossiness to be formed in an image forming apparatus. Conventionally, glossiness is given to an image by a method of changing a fixing temperature or a method of changing a pressure distribution in the fixing nip. Conventional techniques for giving glossiness to an image by the method of changing the pressure distribution in the fixing nip are disclosed in, for example, JP 2007-328046 A and JP 2004-184476 A.

Disclosed in JP 2007-328046 A is a technique for performing gloss control by changing a peak position of the pressure distribution formed at a nip portion in the direction of conveying a recording medium in a fixing device that has the nip portion for holding and conveying the recording medium, and fixes an unfixed image on the recording medium at the nip portion.

Disclosed in JP 2004-184476 A is a technique for controlling the gloss of an image forming part in a fixing device that holds a transfer material at a nip portion, and fixes an unfixed toner image by applying heat and pressure thereto. In the nip, there are provided a high pressure portion higher in pressure than a preset threshold value and a low pressure portion lower in pressure than the preset threshold value. The ratio of the area of the high pressure portion to the area of the low pressure portion is variable.

In the prior art, the correlation between a fixing temperature, a pressure distribution in the fixing nip, and glossiness given to an image is not sufficiently clear. Thus, it is not possible to effectively control the glossiness of the image. Furthermore, in the prior art, there is a possibility that fixing performance such as fixing properties and fixing noise (uneven glossiness generated in an image due to the way of applying heat and pressure) may be adversely affected. Moreover, in the conventional technique in which the pressure distribution is changed in the fixing nip, the pressure distribution is changed in an area in which a high pressure is applied to a paper sheet. This increases the wear rate of a fixing belt, and reduces the life of the fixing belt.

SUMMARY

The present invention is intended to solve the above-described problems, and an object of the present invention is to provide a fixing device and an image forming apparatus capable of effectively controlling the glossiness of an image while preventing an influence on fixing performance.

In addition, another object of the present invention is to provide a fixing device and an image forming apparatus capable of preventing a decrease in the life of a fixing belt.

To achieve at least one of the abovementioned objects, there is provided a fixing device for fixing a toner image on a paper sheet by conveying the paper sheet on which the toner image has been formed while holding the paper sheet at a fixing nip, and the fixing device reflecting one aspect of the present invention comprises: an endless belt that rotates, the belt being provided on a side facing the toner image formed on the paper sheet; a pressing member that is disposed on an inner side of the belt, and presses the belt from the inner side; a pressure member that is disposed on an outer side of the belt, and forms the fixing nip between the pressure member and the belt by pressing, from the outer side of the belt, a portion of the belt pressed by the pressing member; and a hardware processor that controls glossiness of the toner image formed on the paper sheet by changing a shear force to be applied to the toner image formed on the paper sheet within a predetermined range from a nip inlet that is an end of the fixing nip, located upstream in a direction in which the paper sheet is conveyed.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

The case where an image forming apparatus on which a fixing device is to be mounted is a multifunction peripheral (MFP) will be described in the following embodiment. The image forming apparatus on which the fixing device is to be mounted may be a facsimile machine, a copying machine, a printer, or the like as well as the MFP. In addition, the image forming apparatus may be either for monochrome printing or color printing.

[Configurations of Image Forming Apparatus and Fixing Device]

First, described below are the configurations of an image forming apparatus and a fixing device according to the present embodiment.

Figure 1:
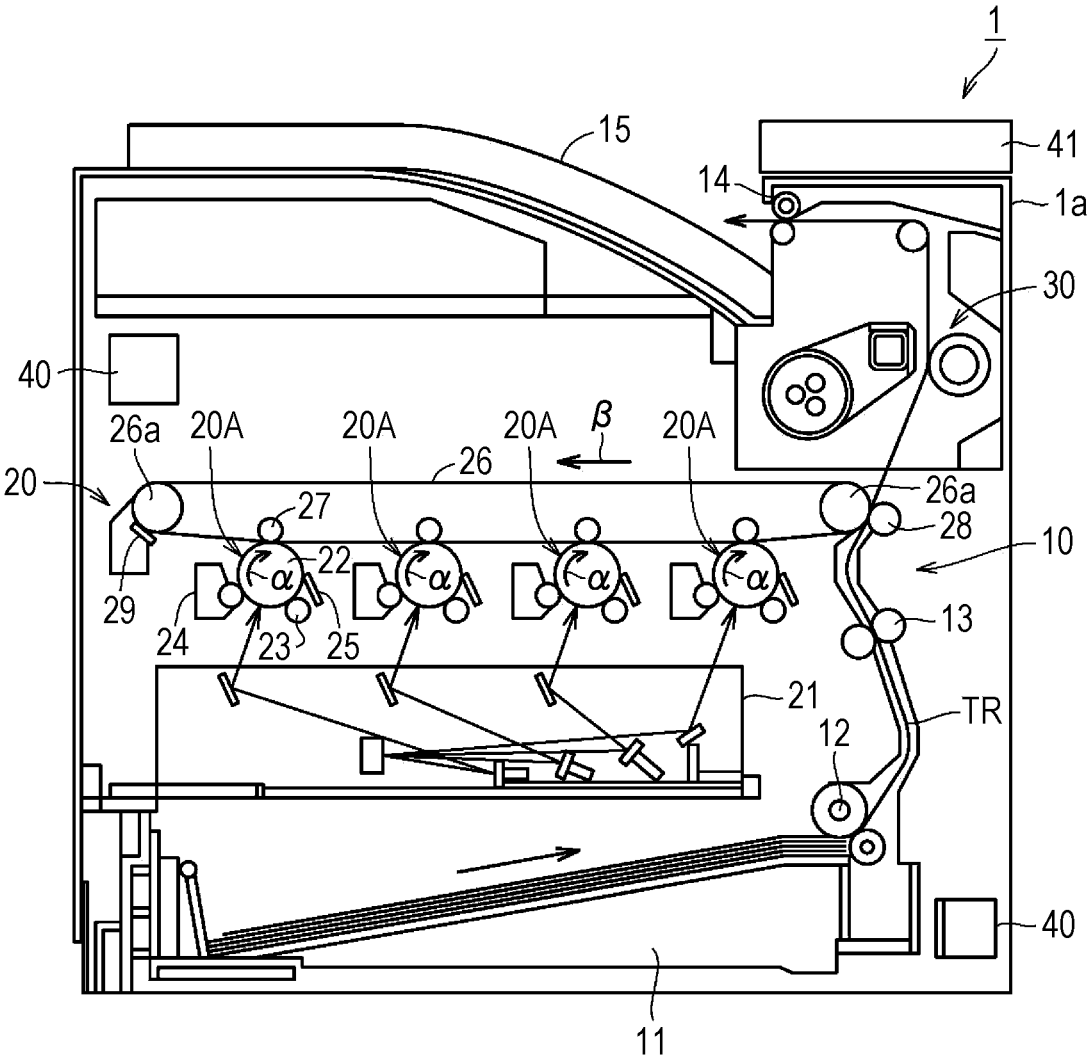
FIG. 1 is a schematic cross-sectional view of the configuration of an image forming apparatus according to an embodiment of the present invention.

FIG. 1 is a schematic cross-sectional view of the configuration of an image forming apparatus 1 according to the embodiment of the present invention.

Referring to FIG. 1, the image forming apparatus 1 according to the present embodiment is an MFP, and mainly includes a paper conveying part 10, a toner image forming part 20 (an example of an image forming part), a fixing device 30, a controller 40 (an example of a glossiness control unit), and an operation display part 41 (an example of a receptor).

The paper conveying part 10 conveys a paper sheet along a conveying path (conveyance direction) TR. The paper conveying part 10 includes a paper feed tray 11, a paper feed roller 12, a registration roller 13, a paper discharge roller 14, and a paper discharge tray 15. The paper feed tray 11 stores paper sheets on which images are to be formed. A plurality of the paper feed trays 11 may be provided. The paper feed roller 12 is provided between the paper feed tray 11 and the conveying path TR. The registration roller 13 is provided upstream of a secondary transfer roller 28 on the conveying path TR. The paper discharge roller 14 is provided at a most downstream part of the conveying path TR. The paper discharge tray 15 is provided on the top of an image forming apparatus main body 1*a*.

The toner image forming part 20 combines images of four colors of yellow (Y), magenta (M), cyan (C), and black (K) in the so-called tandem system to form a toner image on a conveyed paper sheet. The toner image forming part 20 includes an image forming unit 20A for each of the colors of Y, M, C, and K, an exposure device 21, an intermediate transfer belt 26, a primary transfer roller 27 for each of the colors of Y, M, C, and K, the secondary transfer roller 28, and a cleaning blade 29.

The respective image forming units 20A for the colors of Y, M, C, and K are provided in this order along the direction of rotation of the intermediate transfer belt 26 indicated by an arrow β, between the exposure device 21 and the intermediate transfer belt 26. The image forming unit 20A for each of the colors of Y, M, C, and K includes a photosensitive drum 22, a charging roller 23, a developing device 24, a cleaning blade 25, and the like. The photosensitive drum 22 is rotationally driven in a direction indicated by an arrow α in FIG. 1. The charging roller 23, the developing device 24, and the cleaning blade 25 are provided around the photosensitive drum 22. The charging roller 23 is provided in proximity to the photosensitive drum 22.

The intermediate transfer belt 26 is provided above the respective image forming units 20A for the colors of Y, M, C, and K. The intermediate transfer belt 26 is annular, and is wound around a rotary roller 26*a*. The intermediate transfer belt 26 is rotationally driven in the direction indicated by the arrow β in FIG. 1. The respective primary transfer rollers 27 for the colors of Y, M, C, and K face the respective photosensitive drums 22 with the intermediate transfer belt 26 interposed therebetween. The secondary transfer roller 28 is in contact with the intermediate transfer belt 26 on the conveying path TR. The cleaning blade 29 is in contact with a surface of the intermediate transfer belt 26.

The fixing device 30 fixes a toner image on a paper sheet by conveying the paper sheet on which the toner image has been formed along the conveying path TR while holding the paper sheet at the fixing nip.

The image forming apparatus 1 rotates the photosensitive drum 22 to cause the surface of the photosensitive drum 22 to be uniformly charged by the charging roller 23. The image forming apparatus 1 causes the exposure device 21 to expose the charged surface of the photosensitive drum 22, according to image forming information, to form an electrostatic latent image on the surface of the photosensitive drum 22.

The exposure device 21 forms an image based on a signal corresponding to an image received from the controller 40. An exposure interval is set to a predetermined interval dpi (resolution) so as to form a screen dpi image. The exposure device 21 may include a polygon mirror and a laser, or may include a line light emitting element of a light-emitting diode (LED). In the case of a resolution of 600 dpi, the dot spacing of the LED is 42.3 μm. In the case of a resolution of 1,200 dpi, the dot spacing of the LED is 21.2 μm.

Next, the image forming apparatus 1 causes the developing device 24 to supply toner to the photosensitive drum 22 on which the electrostatic latent image has been formed, to perform development. As a result, a toner image is formed on the surface of the photosensitive drum 22.

Then, the image forming apparatus 1 causes each primary transfer roller 27 to sequentially transfer the toner image formed on each photosensitive drum 22 to the surface of the intermediate transfer belt 26 at the position of contact between each photosensitive drum 22 and the intermediate transfer belt 26 (primary transfer). In the case of a full color image, each time a toner image transferred to the intermediate transfer belt 26 passes through each image forming unit 20A, a toner image of each color is superimposed on the toner image. As a result, a full color toner image is formed on the intermediate transfer belt 26. The image forming apparatus 1 causes the cleaning blade 25 to remove toner that has remained on the surface of the photosensitive drum 22 instead of being transferred to the intermediate transfer belt 26.

Subsequently, the image forming apparatus 1 causes the rotary roller 26*a* to convey the toner image formed on the surface of the intermediate transfer belt 26 to a position where the toner image is to face the secondary transfer roller 28.

Meanwhile, the image forming apparatus 1 causes the paper sheets stored in the paper feed tray 11 to be fed one by one by the paper feed roller 12, and be guided by the registration roller 13 to a position between the intermediate transfer belt 26 and the secondary transfer roller 28 at a predetermined timing. Then, the image forming apparatus 1 causes the secondary transfer roller 28 to transfer the toner image formed on the surface of the intermediate transfer belt 26 to the paper sheet. The image forming apparatus 1 causes the cleaning blade 29 to remove toner that has remained on the surface of the intermediate transfer belt 26 instead of being transferred to the paper sheet. The toner removed by the cleaning blade 25 or 29 is conveyed by a conveyance screw (not shown) and put in a waste toner container (not shown).

The image forming apparatus 1 guides the paper sheet to which the toner image has been transferred to the fixing device 30, and causes the fixing device 30 to fix the toner image on the paper sheet. Subsequently, the image forming apparatus 1 causes the paper discharge roller 14 to discharge the paper sheet on which the toner image has been fixed onto the paper discharge tray 15.

The controller 40 includes a central processing unit (CPU), a read only memory (ROM), a random access memory (RAM), and the like. The controller 40 controls the entire image forming apparatus 1. In particular, the controller 40 controls the glossiness of the toner image formed on the paper sheet by a method to be described below.

The operation display part 41 is provided on the top of the image forming apparatus main body 1*a*. The operation display part 41 includes a display for displaying various information for a user, and an operation part for receiving various operation inputs from the user.

Figure 2A:
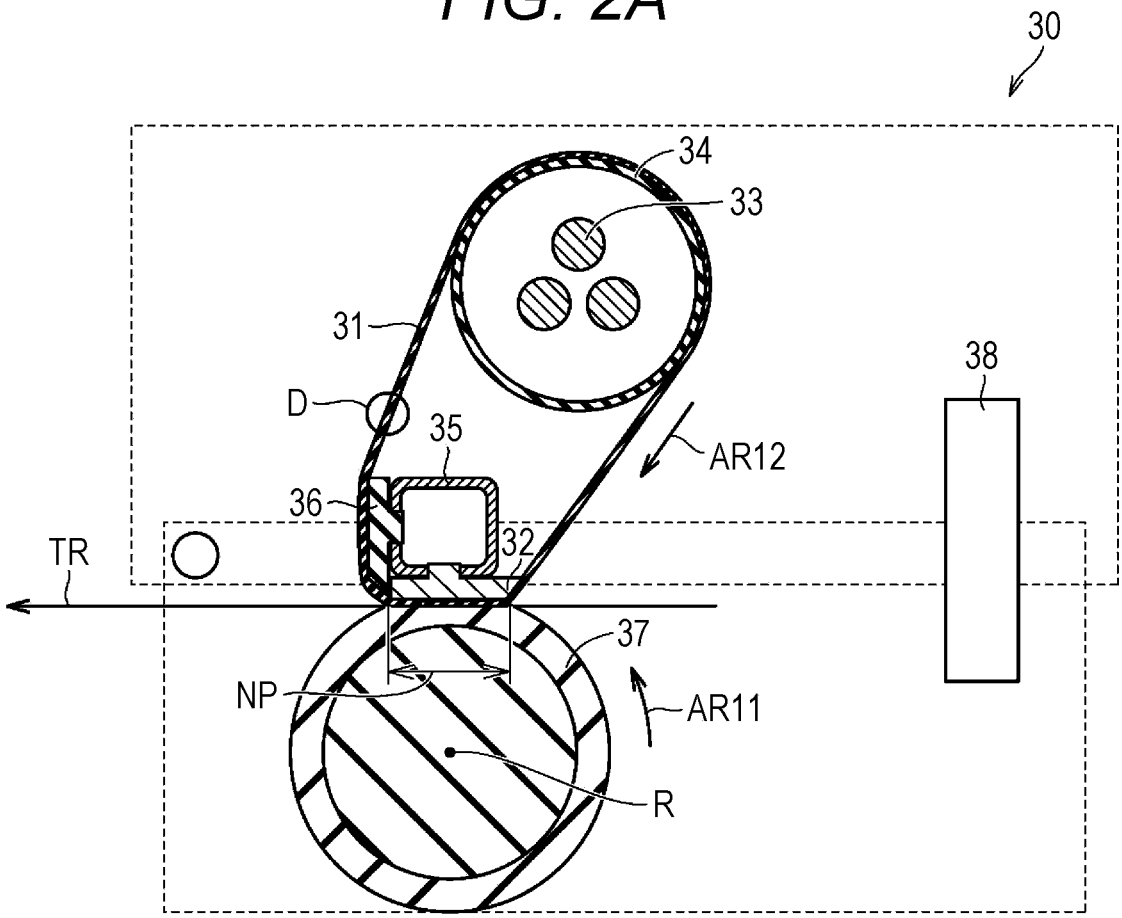
FIGS. 2A and 2B are schematic cross-sectional views of the configuration of a fixing device according to the embodiment of the present invention.
Figure 2B:
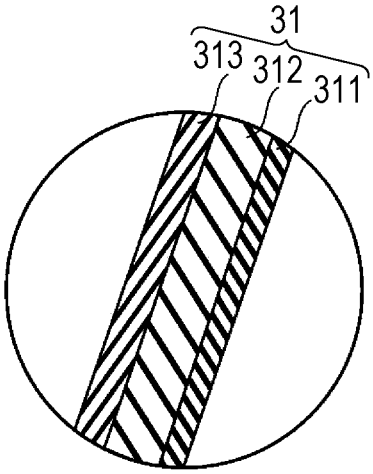

FIGS. 2A and 2B are schematic cross-sectional views of the configuration of the fixing device 30 according to the embodiment of the present invention. FIG. 2A is a view of the entire configuration of the fixing device 30. FIG. 2B is an enlarged view of a portion D in FIG. 2A.

Referring to FIGS. 2A and 2B, the fixing device 30 includes a fixing belt 31 (an example of a belt), a pressing pad 32 (an example of a pressing member), a heater 33, a heating roller 34, a support member 35, a lubricant application member 36, a pressure roller 37 (an example of a pressure member), and a contact pressure spring 38.

The fixing belt 31 is an endless belt, and is provided on a side facing the toner image formed on the conveyed paper sheet (upper side in FIGS. 2A and 2B). The fixing belt 31 is supported at a position where the fixing belt 31 is pressed against the pressure roller 37 to form a fixing nip NP while being held by guide members (side plates) (not shown) at both ends in an axial direction. The fixing belt 31 is stretched around the pressing pad 32, the heating roller 34, and the lubricant application member 36. The fixing belt 31 is tensioned by a biasing unit (not shown).

The fixing belt 31 has an outer diameter of, for example, 70 mm. The fixing belt 31 includes a base material layer 311, an elastic layer 312, and a surface layer 313. The elastic layer 312 is provided on the outer peripheral side of the base material layer 311. The surface layer 313 is provided on the outer peripheral side of the elastic layer 312 and on the outermost surface of the fixing belt 31. The base material layer 311 preferably has a thickness of 60 μm to 80 μm inclusive. The elastic layer 312 preferably has a thickness of 200 μm to 1,200 μm inclusive. The surface layer 313 preferably has a thickness of 20 μm to 100 μm inclusive.

The JIS-A hardness of the elastic layer 312 is preferably between 13° and 80° inclusive. The JIS-A hardness refers to a value measured by use of a type-A durometer at a temperature of 25° C. in conformity with the hardness test method defined in JIS K6253.

The pressing pad 32 is made of liquid crystal polymer resin or the like, and is disposed on the inner side of the fixing belt 31. The pressing pad 32 extends in parallel to a direction in which a central axis R of the pressure roller 37 extends. The pressing pad 32 presses the fixing belt 31 from the inner side of the fixing belt 31. The specific configuration of the pressing pad 32 will be described below.

The heater 33 includes, for example, a halogen heater, and is provided inside the heating roller 34. The heater 33 extends in parallel to the direction in which the central axis R of the pressure roller 37 extends. The heater 33 heats the fixing belt 31 to a predetermined target temperature via the heating roller 34.

The heating roller 34 has a cylindrical shape, and is provided on the inner side of the fixing belt 31. The heating roller 34 transfers heat from the heater 33 to the fixing belt 31, and is driven by the rotation of the fixing belt 31. The heating roller 34 has a rotating shaft parallel to the direction in which the central axis R of the pressure roller 37 extends.

The support member 35 is provided on the inner side of the fixing belt 31. The support member 35 extends in parallel to the direction in which the central axis R of the pressure roller 37 extends. The support member 35 supports the pressing pad 32, and fixes the position of the pressing pad 32.

The lubricant application member 36 applies a lubricant to the inner peripheral surface of the fixing belt 31 to supply the lubricant to a sliding portion between the fixing belt 31 and the pressing pad 32. The lubricant application member 36 is fixed to the support member 35 with a double-sided adhesive tape, an adhesive, or the like. The lubricant application member 36 extends in parallel to the central axis R of the pressure roller 37. The lubricant application member 36 is made of a material, such as felt, that can be impregnated with a lubricant.

The pressure roller 37 is disposed on the outer side of the fixing belt 31 in such a way as to face the pressing pad 32 via the fixing belt 31. The pressure roller 37 forms the fixing nip NP between itself and the fixing belt 31 by pressing, from the outer side of the fixing belt 31, a portion of the fixing belt 31 pressed by the pressing pad 32. The pressure roller 37 is a rotating body, and is rotationally driven in a direction indicated by an arrow AR11. The fixing belt 31 follows the rotation of the pressure roller 37 to rotate in a direction indicated by an arrow AR12. The pressure roller 37 includes an elastic layer and a release layer formed on the surface of the elastic layer. The elastic layer is made of silicone rubber, and has a diameter of approximately 20 mm to 40 mm. The release layer is formed of, for example, a tube of a fluorine-based material so as to increase release properties. It should be noted that a pad-like pressure member that is not rotatable may also be adopted instead of the pressure roller 37.

The contact pressure spring 38 adjusts contact pressure between the fixing belt 31 and the pressure roller 37 under the control of the controller 40.

As an example, the fixing device 30 has the following specific configuration. In the fixing belt 31, the base material layer 311 is made of polyimide (PI), nickel (Ni), or the like, and has a thickness of, for example, 80 μm. The elastic layer 312 is made of silicone rubber or the like, and has a thickness of, for example, 200 μm. The surface layer 313 is made of fluororesin (PFA) or the like, and has a thickness of 30 μm. The pressing pad 32 includes a main body and a sliding sheet. The main body is made of, for example, liquid crystal polymer resin (LCP). The sliding sheet is made of a glass cloth impregnated with fluororesin, and is wound around a surface of the main body in contact with the fixing belt 31. The sliding sheet has an effect of reducing a coefficient of friction between the fixing belt 31 and the pressing pad 32 to achieve smooth sliding. The power consumption of the heater 33 is, for example, 1,000 W, and the control temperature thereof is, for example, 170° C. The heating roller 34 has an outer diameter of, for example, 40 mm, and includes an aluminum layer and a surface layer. The aluminum layer has a thickness of 0.7 mm. The surface layer has a thickness of 40 μm, and is coated with polytetrafluoroethylene (PTFE). The pressure roller 37 has an outer diameter of, for example, 50 mm, and includes a core metal, an elastic layer, and a surface layer. The core metal is made of iron with an outer diameter of 40 mm. The elastic layer has a thickness of 5 mm. The surface layer is made of fluororesin (PFA), and has a thickness of 20 μm. The pressure roller 37 is rotated by a drive source (not shown) at 415 mm/s. The contact pressure spring 38 adjusts the contact pressure in a range of 700 N to 1,000 N depending on the length thereof. The length (width) of the fixing nip NP along the conveying path TR is 18 mm, and the length (longitudinal width) thereof in a direction orthogonal to the conveying path TR is 320 mm.

[Detailed Configuration of Pressing Pad and Operation for Controlling Glossiness]

Next, described below is the detailed configuration of the pressing pad 32 and operation for controlling glossiness in the present embodiment.

Figure 3B:
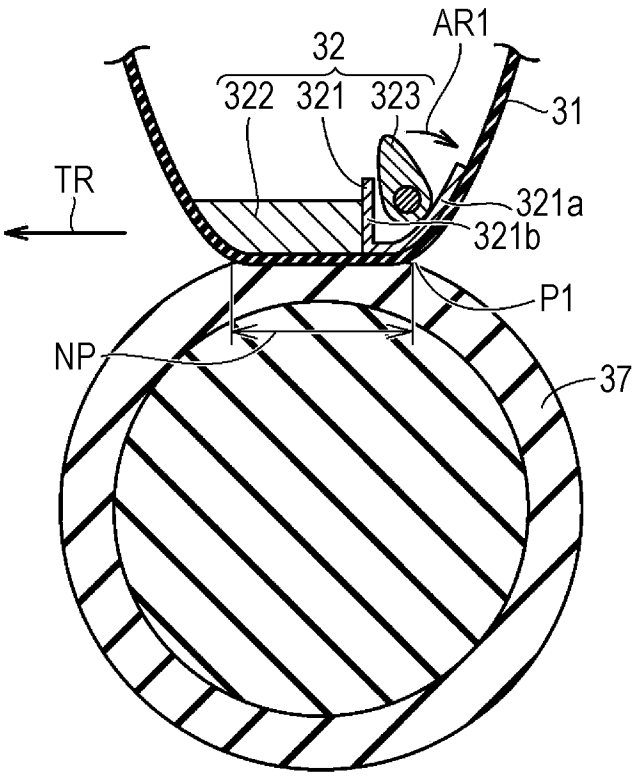
FIGS. 3A and 3B are cross-sectional views of the configurations of a portion in the vicinity of a pressing pad in the fixing device according to the embodiment of the present invention.
Figure 3A:
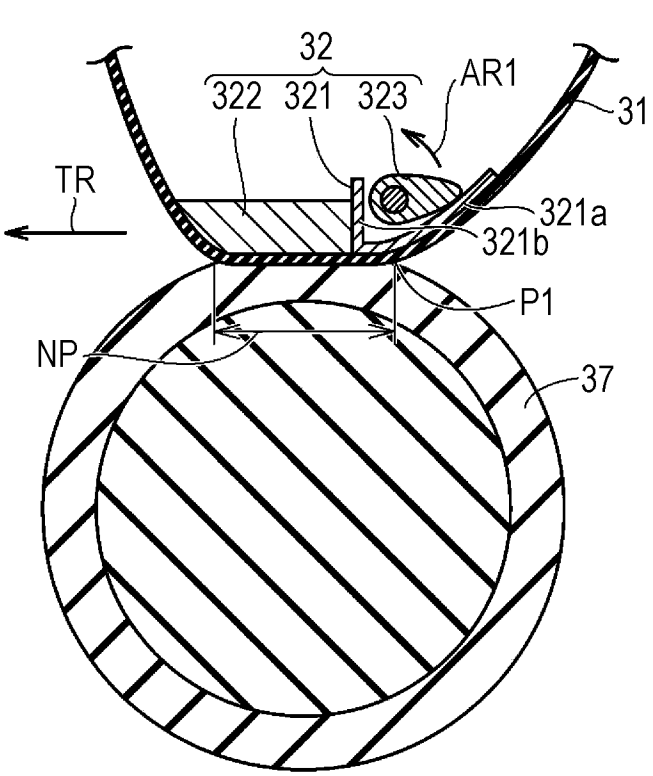
Figure 4A:
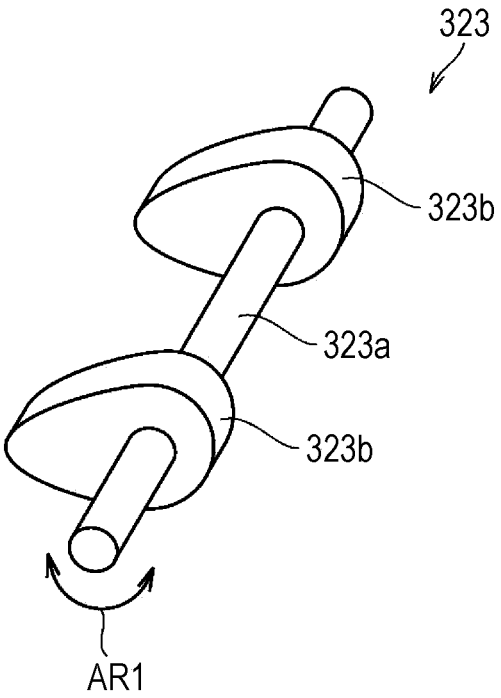
FIGS. 4A and 4B are schematic perspective views of the configurations of a camshaft in the pressing pad according to the embodiment of the present invention.
Figure 4B:
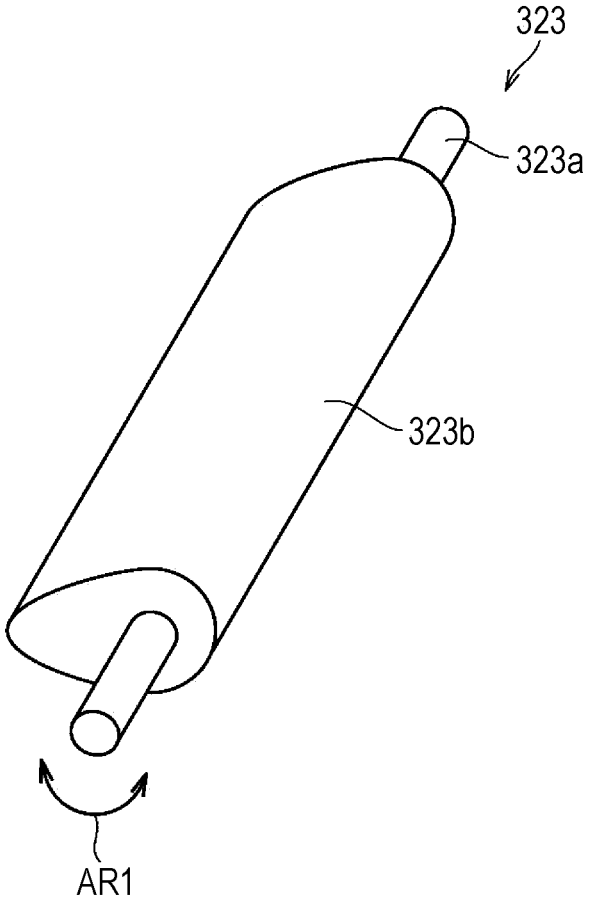

FIGS. 3A and 3B are cross-sectional views of the configurations of a portion in the vicinity of the pressing pad 32 in the fixing device 30 according to the embodiment of the present invention. FIGS. 4A and 4B are schematic perspective views of the configurations of a camshaft 323 in the pressing pad 32 according to the embodiment of the present invention. FIG. 4A is a view of a first configuration of the camshaft 323, and FIG. 4B is a view of a second configuration of the camshaft 323.

Referring to FIGS. 3A and 3B, the pressing pad 32 includes an inlet side member 321 (an example of a first pressing member), an outlet side member 322 (an example of a second pressing member), and the camshaft 323. The inlet side member 321 is provided upstream of the outlet side member 322 on the conveying path TR. The inlet side member 321 has a plate shape. The inlet side member 321 is substantially L-shaped in cross-section. The inlet side member 321 is formed of, for example, a leaf spring. The shape of the inlet side member 321 can be reversibly changed by an external force or the like.

The inlet side member 321 includes a contact portion 321*a* and a bent portion 321*b*. The outer peripheral surface of the contact portion 321*a* is in contact with the fixing belt 31. The contact portion 321*a* extends along a direction of the rotation of the fixing belt 31. The inlet side member 321 presses a portion of the fixing belt 31, which forms an upstream side portion of the fixing nip NP (inlet side portion of the fixing nip NP) on the conveying path TR.

The bent portion 321*b* is provided closer to the outlet side member 322 than the contact portion 321*a*, and extends from an end of the contact portion 321*a* in a direction away from the fixing belt 31. The bent portion 321*b* is fixed to the outlet side member 322.

The outlet side member 322 is provided downstream of the inlet side member 321 on the conveying path TR. The outlet side member 322 is fixed to the support member 35. The outlet side member 322 is stationary. The shape of the outlet side member 322 is invariable. The outlet side member 322 presses the fixing belt 31 at a downstream side on the conveying path TR with respect to a pressing position where the fixing belt 31 is pressed by the inlet side member 321 (at the outlet side of the fixing nip NP).

Referring to FIGS. 4A and 4B, the camshaft 323 includes a rotating shaft 323*a* and a cam 323*b*. The cam 323*b* is attached to the rotating shaft 323*a*, and is swingable as indicated by the arrow AR1 with respect to the rotating shaft 323*a* under the control of the controller 40. The cam 323*b* has an outer peripheral surface configured such that the distance from the rotating shaft 323*a* varies. A plurality of the cams 323*b* may be provided at a plurality of positions in a direction in which the rotating shaft 323*a* extends, as shown in FIG. 4A. Alternatively, the cam 323*b* may extend in parallel to the direction in which the rotating shaft 323*a* extends, as shown in FIG. 4B.

Referring to FIGS. 3A and 3B, the cam 323*b* is in contact with the inner peripheral surface of the contact portion 321*a*. The contact portion 321*a* can be pressed by the cam 323*b* at different positions on the outer peripheral surface of the cam 323*b* as the rotating shaft 323*a* rotates. The controller 40 causes the camshaft 323 to change the curvature of a part of the contact portion 321*a* that presses the fixing belt 31.

Specifically, when the contact portion 321*a* is in contact with the outer peripheral surface of the cam 323*b* at a position thereon where the distance from the rotating shaft 323*a* is long as shown in FIG. 3A, a pressing force to be applied when the cam 323*b* presses the contact portion 321*a* increases. The contact portion 321*a* deforms in a direction in which the curvature is reduced by the pressing force (in a direction in which the degree of bending with respect to the bent portion 321*b* is reduced). The fixing belt 31 is pressed by the contact portion 321*a* at a nip inlet P1. Therefore, the fixing belt 31 deforms together with the contact portion 321*a* in the direction in which the curvature is reduced.

Meanwhile, when the contact portion 321*a* is in contact with the outer peripheral surface of the cam 323*b* at a position thereon where the distance from the rotating shaft 323*a* is short as shown in FIG. 3B, the pressing force to be applied when the cam 323*b* presses the contact portion 321*a* decreases. The contact portion 321*a* deforms in a direction in which the curvature increases due to an urging force of the inlet side member 321 (in a direction in which the degree of bending with respect to the bent portion 321*b* increases). The fixing belt 31 also deforms at the nip inlet P1 together with the contact portion 321*a* in the direction in which the curvature increases.

The inventors of the present application have found that the glossiness of a toner image formed on a paper sheet is related to the smoothness of the surface of the toner image, and the smoothness of the surface of the toner image is related to the amount of wax exuding to the surface of toner containing the wax. That is, when the amount of wax exuding to the surface of toner is large, the smoothness of the surface of a toner image increases, and the glossiness of the toner image increases. Meanwhile, when the amount of wax exuding to the surface of toner is small, the smoothness of the surface of a toner image decreases, and the glossiness of the toner image decreases. Furthermore, the inventors of the present application have found that it is effective to apply an external force to toner at the timing when the toner is in a semi-molten state, not in a sufficiently molten state, so as to cause wax to effectively exude to the surface of the toner.

Therefore, the controller 40 changes the curvature of the fixing belt 31 within a predetermined range from the nip inlet P1 by changing the curvature of the contact portion 321*a*. The controller 40 changes the curvature of the fixing belt 31 based on, for example, the type of paper sheet on which a toner image is to be formed, and settings on the fixing device received through the operation display part 41 and the like (for example, a setting regarding printing conditions for giving glossiness, performed by a user, and a setting for adjusting the glossiness of an image performed by a service staff member). As a result, the controller 40 changes a shear force to be applied to a toner image formed on a paper sheet to control the glossiness of the toner image formed on the paper sheet.

Figure 5A:
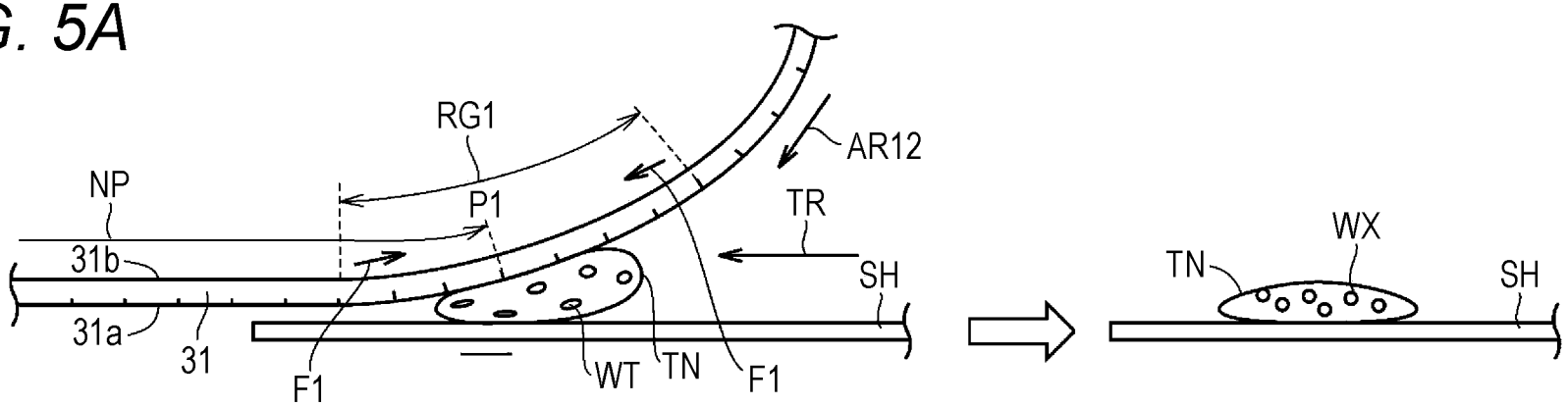
FIGS. 5A and 5B are diagrams schematically showing the relationship between the curvature of a fixing belt and the glossiness of a toner image in the embodiment of the present invention.
Figure 5B:
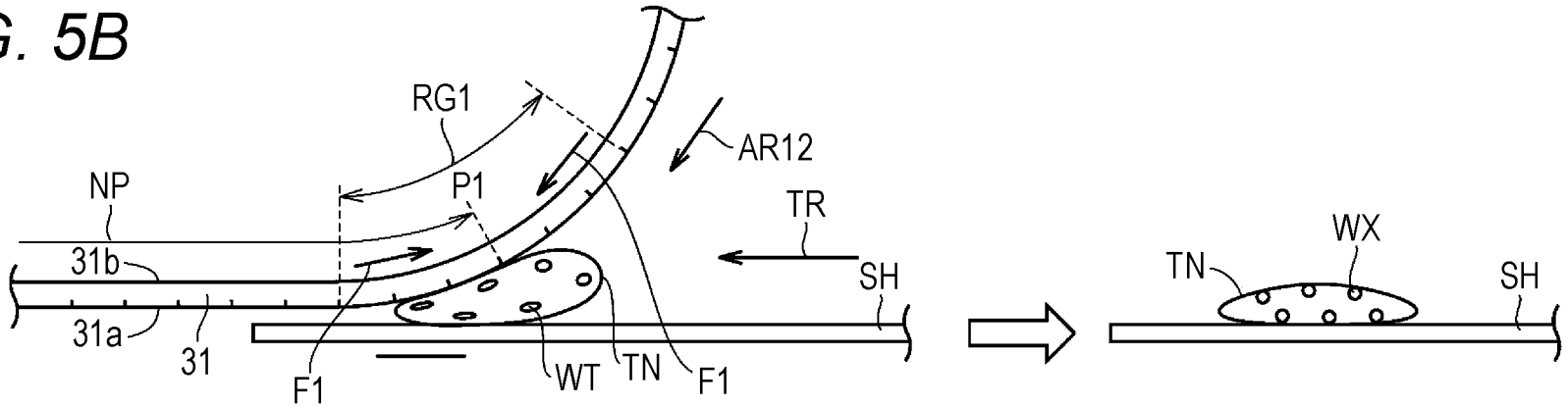

FIGS. 5A and 5B are diagrams schematically showing the relationship between the curvature of the fixing belt 31 and the glossiness of the toner image in the embodiment of the present invention. It should be noted that in FIGS. 5A and 5B, a plurality of straight lines indicating the degree of stretch of an outer peripheral surface 31*a* (stretch of the surface layer 313) of the fixing belt 31 is shown in the fixing belt 31 for the convenience of description.

Referring to FIGS. 5A and 5B, a portion of the fixing belt 31 forming the fixing nip NP is relatively flat. In this portion, neither the outer peripheral surface 31*a* nor an inner peripheral surface 31*b* of the fixing belt 31 expands or contracts.

Meanwhile, a portion of the fixing belt 31 located upstream of the fixing nip NP in the rotational direction (direction indicated by the arrow AR12) is relatively curved. In the general fixing belt 31, the base material layer 311 on the innermost peripheral side is made of the hardest material. Therefore, when the fixing belt 31 is in a curved state, the base material layer 311 forming the inner peripheral surface 31*b* hardly contracts, the elastic layer 312 located in the middle deforms, and the surface layer 313 forming the outer peripheral surface 31*a* significantly expands. A neutral plane lies in the middle of the base material layer 311. Therefore, in a region RG1 where the fixing belt 31 shifts from the curved state to a flat state, the outer peripheral surface 31*a* of the rotating fixing belt 31 tends to return from an expanded state to an original state, and a contraction force F1 acts on the outer peripheral surface 31*a* of the fixing belt 31.

At the nip inlet P1, toner TN attached to a paper sheet SH has not yet passed through the fixing nip NP, and exists in the semi-molten state. A shear force caused by the contraction force F1 of the fixing belt 31 is applied to the toner TN in the semi-molten state at the nip inlet P1.

Here, as shown in FIG. 5A, when the curvatures of the contact portion 321*a* and the fixing belt 31 are small (in the case shown in FIG. 3A), the contraction force F1 of the fixing belt 31 is small, and the shear force to be applied to the toner TN is also small accordingly. As a result, wax WX becomes less likely to exude to the surface of the toner TN, and the glossiness of the toner image remains low.

Meanwhile, as shown in FIG. 5B, when the curvatures of the contact portion 321*a* and the fixing belt 31 are large (in the case shown in FIG. 3B), the contraction force F1 of the fixing belt 31 is large, and the shear force to be applied to the toner TN is also large accordingly. As a result, the wax WX easily exudes to the surface of the toner TN, and the glossiness of the toner image increases.

Therefore, when the curvature of the fixing belt 31 at the nip inlet P1 is changed, the shear force to be applied at the nip inlet P1 to a toner image formed on the paper sheet SH changes. As a result, the controller 40 can control the glossiness of the toner image formed on the paper sheet SH.

According to the present embodiment, a shear force is applied to toner at the nip inlet P1, and the shear force is controlled, so that the glossiness of a toner image is controlled. As a result, the glossiness can be efficiently changed. Furthermore, the fixing device 30 applies a relatively small pressure to the toner image at the nip inlet P1. Thus, the glossiness of the toner image is controlled without significantly changing the distribution of the pressure to be applied to the toner image within the fixing nip NP. Therefore, it is possible to prevent an influence on fixing properties, fixing noise, and the like. Moreover, a pressure distribution is not changed in an area where a high pressure is applied to a paper sheet. Therefore, it is possible to prevent a decrease in the life of the fixing belt.

[Variations]

The controller 40 may change the curvature of the fixing belt 31 at the nip inlet P1 in the fixing nip NP by changing the shape of the pressing pad 32 by a method other than the method according to the above-described embodiment. In particular, the controller 40 preferably changes at least one of the shape and position of a portion of the first pressing member that presses the fixing belt 31. In addition, the fixing device 30 may have the following configuration.

Figure 6A:
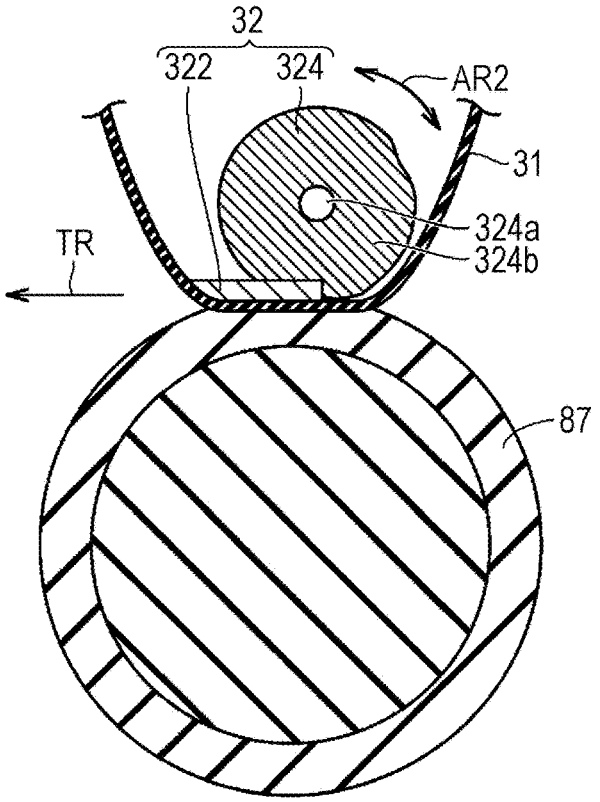
FIGS. 6A and 6B are views of the configurations of a fixing device according to a first variation of the embodiment of the present invention.
Figure 6B:
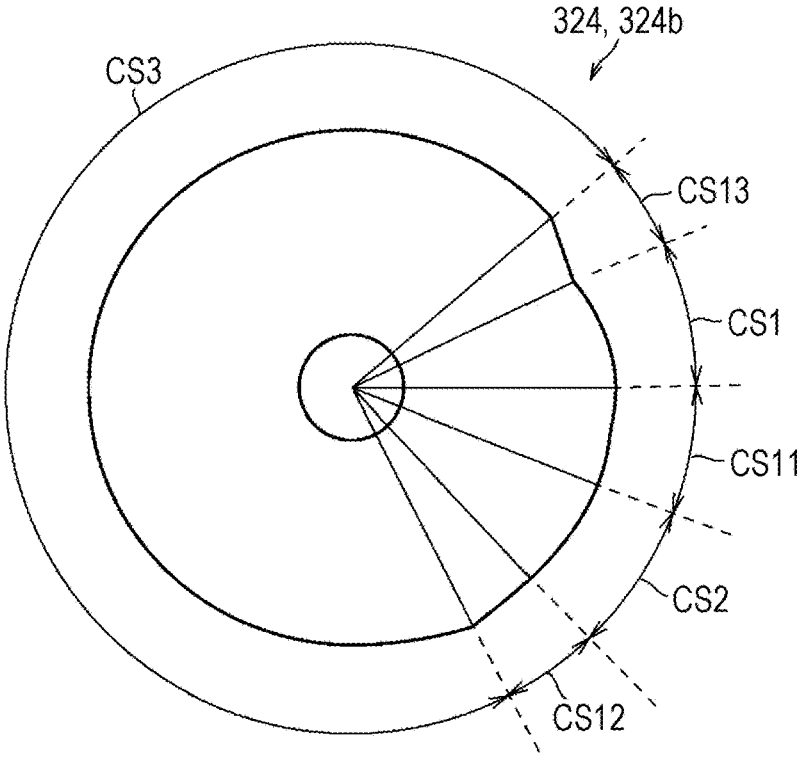

FIGS. 6A and 6B are views of the configurations of a fixing device 30 according to a first variation of the embodiment of the present invention. FIG. 6A is a cross-sectional view of the configuration of a portion in the vicinity of a pressing pad 32 in the fixing device 30. FIG. 6B is a schematic cross-sectional view of the configuration of a camshaft 324 shown in FIG. 6A.

Referring to FIGS. 6A and 6B, in the fixing device 30 according to the first variation, the pressing pad 32 includes an outlet side member 322 and the camshaft 324 (an example of the first pressing member). The outlet side member 322 has a configuration similar to that in the above-described embodiment.

The camshaft 324 is provided upstream of the outlet side member 322 on a conveying path TR. The camshaft 324 presses a portion of a fixing belt 31, which forms an upstream side portion of a fixing nip NP (inlet side portion of the fixing nip NP) on the conveying path TR.

The camshaft 324 has a columnar or cylindrical shape, and includes a rotating shaft 324*a* and a cam 324*b*. The cam 324*b* is attached to the rotating shaft 324*a*, and is swingable as indicated by an arrow AR2 with respect to the rotating shaft 324*a* under the control of a controller 40. The cam 324*b* extends in parallel to a direction in which the rotating shaft 324*a* extends.

The cam 324*b* has three outer peripheral surfaces CS1, CS2, and CS3 with different curvatures. The outer peripheral surface CS1 has a curvature R1. The outer peripheral surface CS2 has a curvature R2 (<R1). The outer peripheral surface CS3 has a curvature R3 (<R2). As an example, the radius of curvature of the outer peripheral surface CS1 is 8 mm, the radius of curvature of the outer peripheral surface CS2 is 12 mm, and the radius of curvature of the outer peripheral surface CS3 is 24 mm.

The controller 40 changes the curvature of the fixing belt 31 at a nip inlet P1 by causing a portion of the cam 324*b* in contact with the fixing belt 31 to switch between the outer peripheral surfaces CS1, CS2, and CS3. As a result, the controller 40 changes a shear force to be applied to a toner image formed on a paper sheet to control the glossiness of the toner image formed on the paper sheet.

Specifically, when the outer peripheral surface CS1 of the cam 324*b* comes into contact with the fixing belt 31, the fixing belt 31 deforms at the nip inlet P1 along the shape of the outer peripheral surface CS1, and the curvature is maximized. Wax easily exudes to the surface of toner, and the glossiness of the toner image increases.

When the outer peripheral surface CS2 of the cam 324*b* comes into contact with the fixing belt 31, the fixing belt 31 deforms at the nip inlet P1 along the shape of the outer peripheral surface CS2, and the curvature is moderate. The wax easily exudes to the surface of the toner to some degree, and the glossiness of the toner image is moderate.

When the outer peripheral surface CS3 of the cam 324*b* comes into contact with the fixing belt 31, the fixing belt 31 deforms at the nip inlet P1 along the shape of the outer peripheral surface CS3, and the curvature is minimized. The wax becomes less likely to exude to the surface of the toner, and the glossiness of the toner image decreases.

It should be noted that as long as the cam 324*b* has a plurality of outer peripheral surfaces with different curvatures, the number of the plurality of outer peripheral surfaces with different curvatures may be larger than three.

The cam 324*b* further includes an outer peripheral surface CS11, an outer peripheral surface CS12, and an outer peripheral surface CS13. The outer peripheral surface CS11 connects the outer peripheral surface CS1 and the outer peripheral surface CS2. The outer peripheral surface CS12 connects the outer peripheral surface CS2 and the outer peripheral surface CS3. The outer peripheral surface CS13 connects the outer peripheral surface CS3 and the outer peripheral surface CS1.

It is preferable that the outer peripheral surface of an inlet side member 321 and the outer peripheral surface of the outlet side member 322 be smoothly connected (in such a way as to reduce a variation in a pressing force to be applied to the fixing belt 31 at a boundary between the outer peripheral surface of the inlet side member 321 and the outer peripheral surface of the outlet side member 322) while the outer peripheral surface CS1, CS2, or CS3 of the cam 324*b* is in contact with the fixing belt 31. For this purpose, it is preferable that each of the outer peripheral surfaces CS11, CS12, and CS13 be configured such that the outer peripheral surface of the outlet side member 322 is tangent to an arc formed by the outer peripheral surface CS11, CS12, or CS13 of the cam 324*b* while the outer peripheral surface CS1, CS2 or CS3 of the cam 324*b* is in contact with the fixing belt 31.

It should be noted that except for the above, the configurations of an image forming apparatus 1 and the fixing device 30 are the same as those in the above-described embodiment and thus, the description thereof will not be repeated.

According to the first variation, the fixing belt 31 can be directly pressed by the camshaft 324.

Figure 7A:
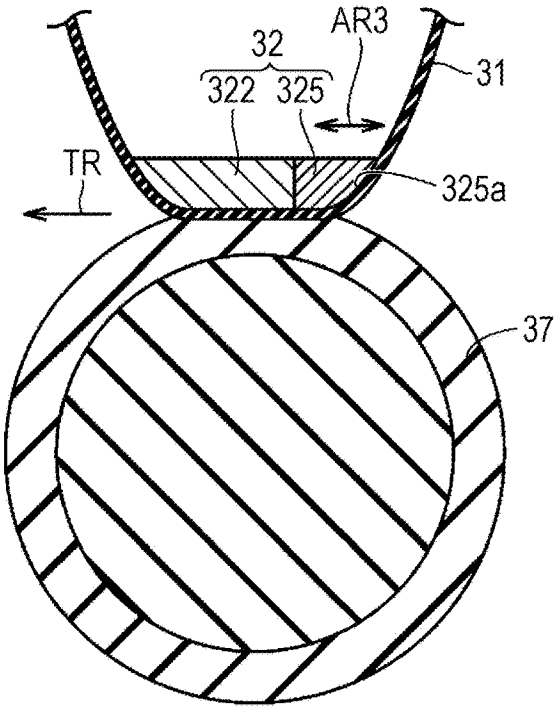
FIGS. 7A to 7C are cross-sectional views of the configurations of a portion in the vicinity of a pressing pad in a fixing device according to a second variation of the embodiment of the present invention.
Figure 7B:
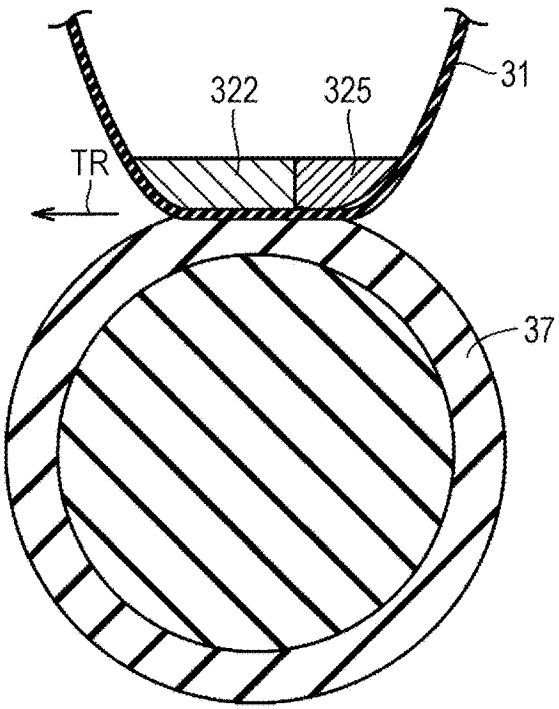
Figure 7C:
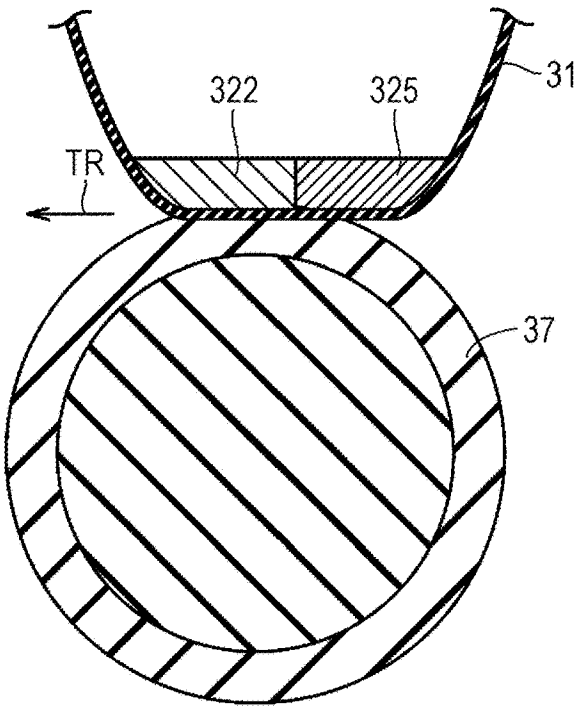
Figure 8A:
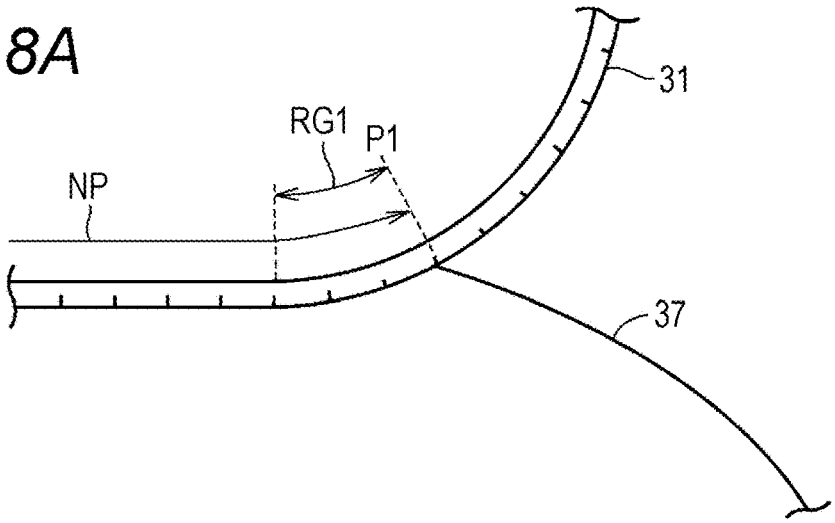
FIGS. 8A to 8C are diagrams schematically showing the relationship between a region and a nip inlet in FIGS. 7A to 7C.
Figure 8B:
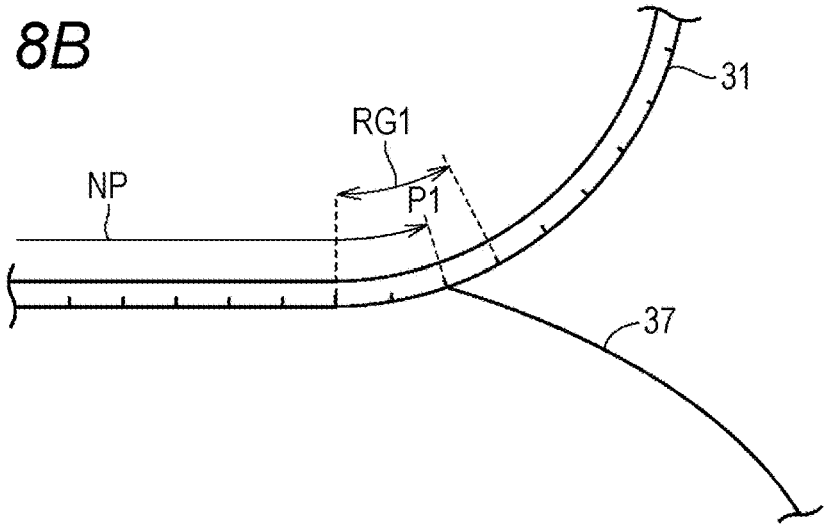
Figure 8C:
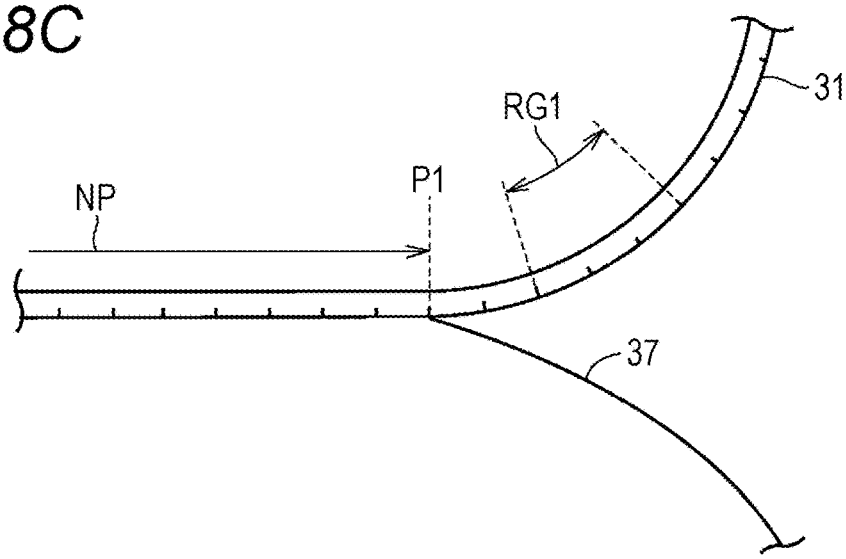

FIGS. 7A to 7C are cross-sectional views of the configurations of a portion in the vicinity of a pressing pad 32 in a fixing device 30 according to a second variation of the embodiment of the present invention. FIGS. 8A to 8C are diagrams schematically showing the relationship between a region RG1 and a nip inlet P1 in FIGS. 7A to 7C. FIGS. 7A and 8A are diagrams showing a state where an inlet side member 325 of the pressing pad 32 is disposed at a first position. FIGS. 7B and 8B are diagrams showing a state where the inlet side member 325 of the pressing pad 32 is disposed at a second position. FIGS. 7C and 8C are diagrams showing a state where the inlet side member 325 of the pressing pad 32 is disposed at a third position.

Referring to FIGS. 7A to 7C and 8A to 8C, in the fixing device 30 according to the second variation, the pressing pad 32 includes an outlet side member 322 and the inlet side member 325 (an example of the first pressing member). The outlet side member 322 has a configuration similar to that in the above-described embodiment.

The inlet side member 325 is provided upstream of the outlet side member 322 on a conveying path TR. A downstream side portion of the inlet side member 325 on the conveying path TR penetrates into the outlet side member 322. The inlet side member 325 has an outer peripheral surface 325*a* with a shape close to the shape of the inner peripheral surface of a fixing belt 31. The outer peripheral surface 325*a* of the inlet side member 325 is in contact with the fixing belt 31, and presses a portion of the fixing belt 31, which forms an upstream side portion of a fixing nip NP (inlet side portion of the fixing nip NP) on the conveying path TR. The inlet side member 325 is movable in a direction indicated by an arrow AR3 (direction along the conveying path TR) under the control of a controller 40.

The controller 40 changes the curvature of the fixing belt 31 at the nip inlet P1 by changing the position of the inlet side member 325 in the direction along the conveying path TR. As a result, the controller 40 changes a shear force to be applied to a toner image formed on a paper sheet to control the glossiness of the toner image formed on the paper sheet.

Specifically, it is assumed that the inlet side member 325 is disposed at the first position, where the inlet side member 325 penetrates deeply into the outlet side member 322, as shown in FIG. 7A. In this state, a major part of the region RG1 where the fixing belt 31 shifts from a curved state to a flat state (region RG1 where a contraction force F1 acts on an outer peripheral surface 31*a*) exists within the fixing nip NP, as shown in FIG. 8A. In this state, a large area of the region RG1 overlaps with the fixing nip NP, and a shear force is applied to toner in a large area in the vicinity of the nip inlet P1. As a result, wax easily exudes to the surface of the toner, and the glossiness of the toner image increases.

Furthermore, it is assumed that the inlet side member 325 is disposed at the second position, where the inlet side member 325 penetrates slightly into the outlet side member 322, as shown in FIG. 7B. In this state, as shown in FIG. 8B, a smaller area of the region RG1 overlaps with the fixing nip NP than in the case shown in FIG. 7A, and an area where a shear force is applied to the toner decreases. As a result, it becomes slightly difficult for the wax to exude to the surface of the toner, and the glossiness of the toner image is moderate.

Moreover, it is assumed that the inlet side member 325 is disposed at the third position, where the inlet side member 325 is adjacent to the outlet side member 322 instead of penetrating into the outlet side member 322, as shown in FIG. 7C. In this state, the region RG1 does not overlap with the fixing nip NP as shown in FIG. 8C, and there exists no area where a shear force is applied to the toner. As a result, the wax becomes less likely to exude to the surface of the toner, and the glossiness of the toner image decreases.

It should be noted that except for the above, the configurations of an image forming apparatus 1 and the fixing device 30 are the same as those in the above-described embodiment and thus, the description thereof will not be repeated.

According to the second variation, it is possible to control the glossiness of a toner image by controlling the size of an area where a shear force is applied to toner. Furthermore, the structure is simple, and a paper sheet can be more stably conveyed than in the case of using a leaf spring. Thus, it is possible to stabilize an angle at which the paper sheet enters the fixing nip.

Figure 9A:
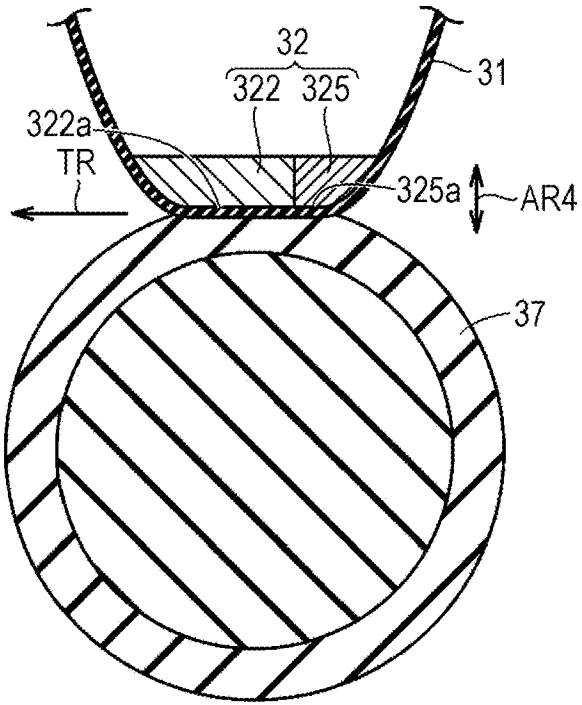
FIGS. 9A to 9C are cross-sectional views of the configurations of a portion in the vicinity of a pressing pad in a fixing device according to a third variation of the embodiment of the present invention.
Figure 9B:
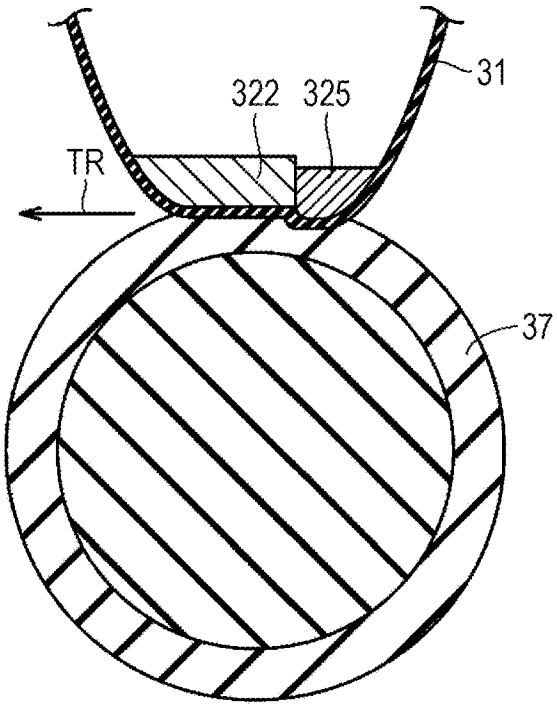
Figure 9C:
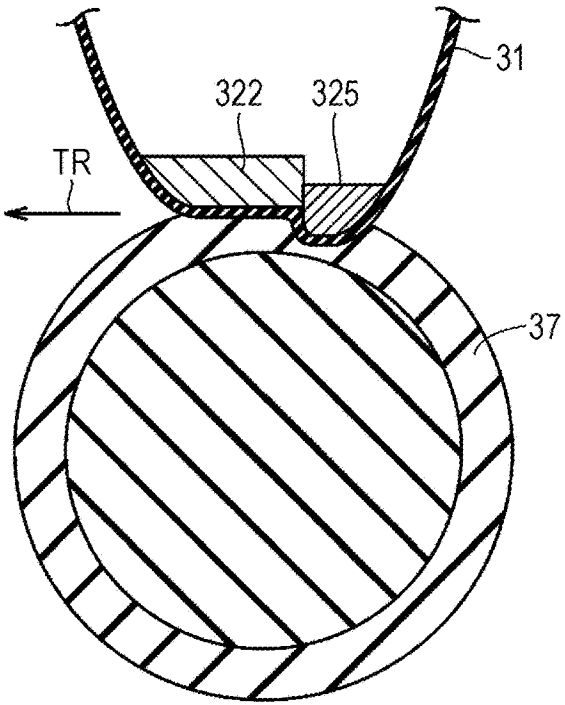
Figure 10:
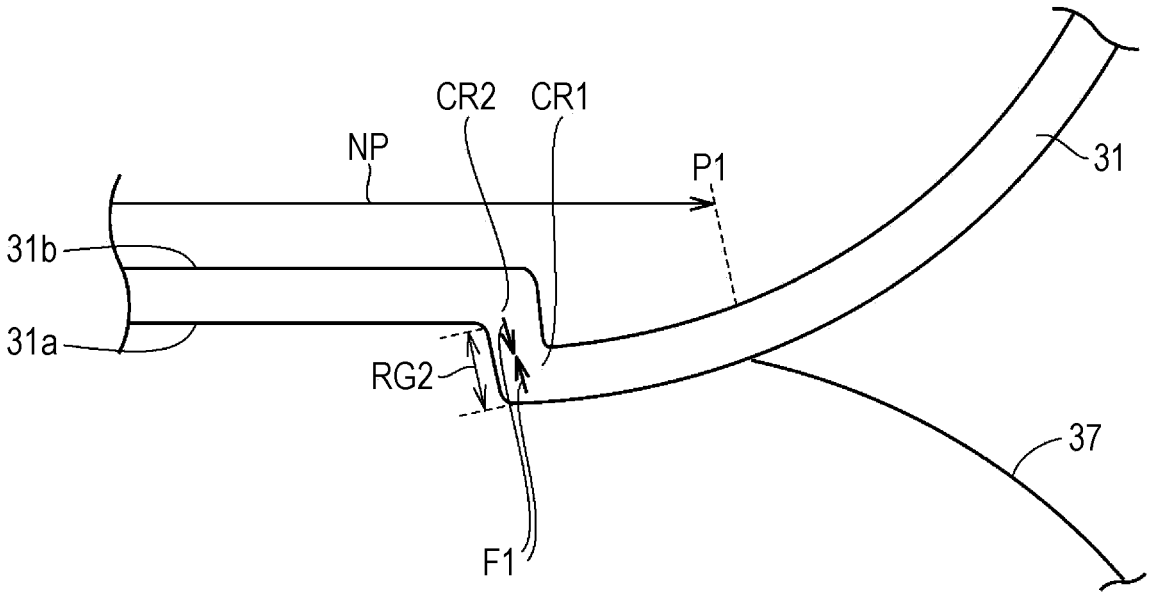
FIG. 10 is a diagram schematically showing the relationship between a region and a nip inlet in FIG. 9B.

FIGS. 9A to 9C are cross-sectional views of the configurations of a portion in the vicinity of a pressing pad 32 in a fixing device 30 according to a third variation of the embodiment of the present invention. FIG. 10 is a diagram schematically showing the relationship between a region RG2 and a nip inlet P1 in FIG. 9B.

Referring to FIGS. 9A to 9C, in the third variation, an inlet side member 325 (an example of the first pressing member) is movable in a direction indicated by an arrow AR4 (direction along a pressing direction in which the inlet side member 325 presses a fixing belt 31) while being in contact with an outlet side member 322 under the control of a controller 40. The third variation differs from the second variation in this respect.

The controller 40 changes the curvature of the fixing belt 31 within a predetermined range from the nip inlet P1 by changing the position of the inlet side member 325 in the direction along the pressing direction. As a result, the controller 40 changes a shear force to be applied to a toner image formed on a paper sheet to control the glossiness of the toner image formed on the paper sheet.

FIG. 10 is a diagram schematically showing the region RG2 in which a contraction force F1 acts on an outer peripheral surface 31*a* of the fixing belt 31 in the third variation of the embodiment of the present invention.

Referring to FIGS. 9A to 9C and 10, when the inlet side member 325 moves in a direction toward a pressure roller 37, corners CR1 and CR2 are formed by a pressing force applied by the inlet side member 325 within the predetermined range from the nip inlet P1 on the fixing belt 31. The corner CR1 is a corner protruding toward the pressure roller 37. The corner CR2 is a corner as a recess with respect to the pressure roller 37.

In the vicinity of the corner CR1, an inner peripheral surface 31*b* of the fixing belt 31 contracts, and the outer peripheral surface 31*a* of the fixing belt 31 expands. Meanwhile, in the vicinity of the corner CR2, the inner peripheral surface 31*b* of the fixing belt 31 expands, and the outer peripheral surface 31*a* of the fixing belt 31 contracts. Therefore, in the region RG2 where the fixing belt 31 shifts from the corner CR1 to the corner CR2, the outer peripheral surface 31*a* of the rotating fixing belt 31 tends to change from an expanded state to a contraction state, and the contraction force F1 acts on the outer peripheral surface 31*a* of the fixing belt 31. The region RG2 exists in the vicinity of the nip inlet P1. Therefore, a shear force caused by the contraction force F1 of the fixing belt 31 is applied to toner TN in a semi-molten state at the nip inlet P1.

Here, when the inlet side member 325 is at a first position where an outer peripheral surface 325*a* of the inlet side member 325 is on the same level as an outer peripheral surface 322*a* of the outlet side member 322 in the pressing direction as shown in FIG. 9A, the region RG2 is not generated, and a shear force to be applied to toner is small. As a result, the wax becomes less likely to exude to the surface of the toner, and the glossiness of the toner image decreases.

Furthermore, when the inlet side member 325 is slightly moved from the first position in the pressing direction and is located at a second position as shown in FIG. 9B, the region RG2 is slightly generated, and an area where a shear force is applied to the toner increases in the vicinity of the nip inlet P1. As a result, the wax easily exudes to the surface of the toner to some degree, and the glossiness of the toner image is moderate.

Moreover, when the inlet side member 325 is moved a great deal from the first position in the pressing direction and is located at a third position as shown in FIG. 9C, the region RG2 becomes wider, and the area where a shear force is applied to the toner becomes wider in the vicinity of the nip inlet P1. The shear force to be applied to the toner also increases. As a result, wax easily exudes to the surface of the toner, and the glossiness of the toner image increases.

It should be noted that except for the above, the configurations of an image forming apparatus 1 and the fixing device 30 are the same as those in the second variation and thus, the description thereof will not be repeated.

According to the third variation, it is possible to control the glossiness of a toner image by controlling the size of an area where a shear force is applied to toner. Furthermore, the structure is simple, and a paper sheet can be more stably conveyed than in the case of using a leaf spring. Thus, it is possible to stabilize an angle at which the paper sheet enters the fixing nip. In addition, the positional relationship between the inlet side member 325 and the outlet side member 322 does not change in a direction along a conveying path TR. It is thus possible to prevent an unnecessary variation in pressure in a fixing nip NP.

Figure 11:
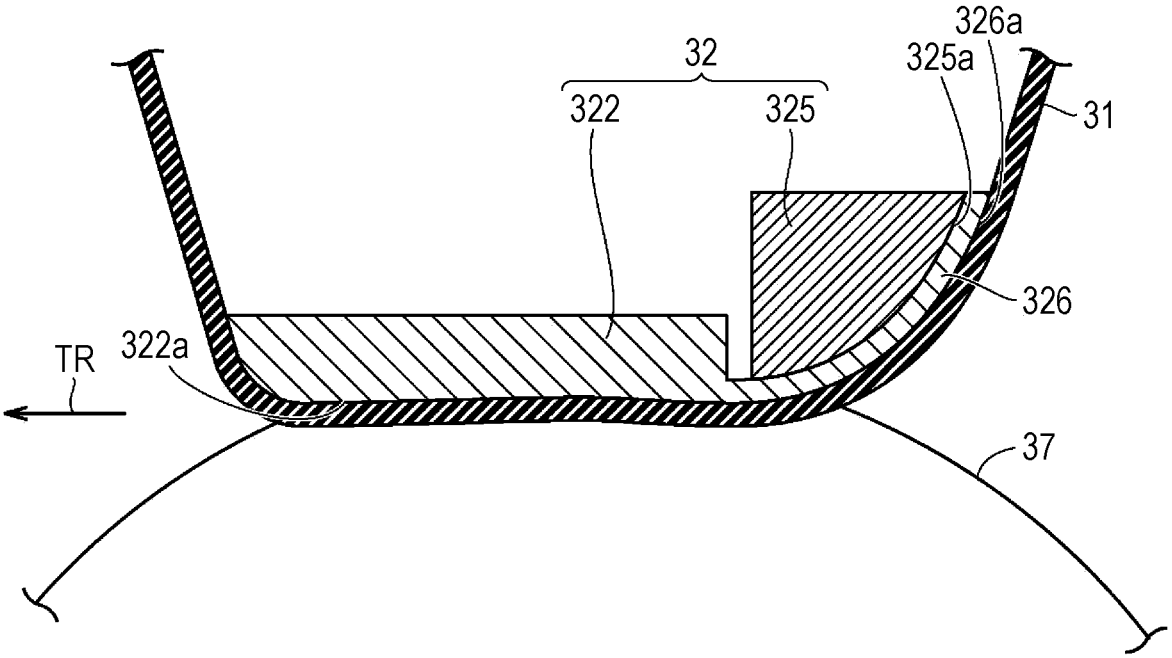
FIG. 11 is a cross-sectional view of the configuration of a portion in the vicinity of a pressing pad in a fixing device according to a fourth variation of the embodiment of the present invention.

FIG. 11 is a cross-sectional view of the configuration of a portion in the vicinity of a pressing pad 32 in a fixing device 30 according to a fourth variation of the embodiment of the present invention.

Referring to FIG. 11, the pressing pad 32 further includes an extending part 326 in the fourth variation. The fourth variation differs from the second or third variation in this respect. That is, the pressing pad 32 includes an outlet side member 322, an inlet side member 325, and the extending part 326.

The extending part 326 is integrally formed with the outlet side member 322. The extending part 326 extends from the outlet side member 322 to a space between a fixing belt 31 and the inlet side member 325. The extending part 326 has an outer peripheral surface 326*a* continuous with an outer peripheral surface 322*a* of the outlet side member 322. The outer peripheral surface 326*a* of the extending part 326 is in contact with the fixing belt 31.

An outer peripheral surface 325*a* of the inlet side member 325 is in contact with the extending part 326. The inlet side member 325 presses a portion of the fixing belt 31, which forms an upstream side portion of a fixing nip NP (inlet side portion of the fixing nip NP) on a conveying path TR via the extending part 326.

It should be noted that except for the above, the configurations of an image forming apparatus 1 and the fixing device 30 are the same as those in the second or third variation and thus, the description thereof will not be repeated.

At a boundary (joint) between the inlet side member 325 and the outlet side member 322, a nip pressure tends to locally decrease. A local decrease in the nip pressure is significant, particularly in the case where the inlet side member 325 is separated from the outlet side member 322 in the second variation, and in the case where the outer peripheral surface 325*a* of the inlet side member 325 is separated from the outer peripheral surface 322*a* of the outlet side member 322 in the third variation. According to the fourth variation, the boundary between the outer peripheral surface 325*a* of the inlet side member 325 and the outer peripheral surface 322*a* of the outlet side member 322 is covered with the extending part 326. It is thus possible to prevent a local decrease in the nip pressure at the boundary between the inlet side member 325 and the outlet side member 322.

Figure 12:
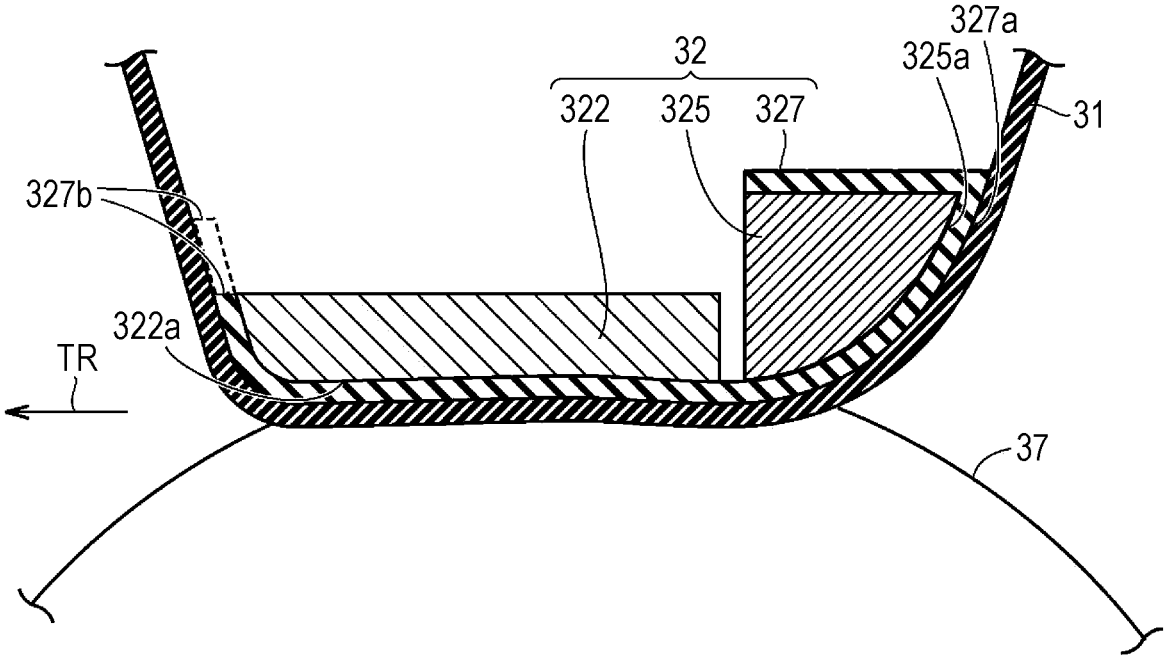
FIG. 12 is a cross-sectional view of the configuration of a portion in the vicinity of a pressing pad in a fixing device according to a fifth variation of the embodiment of the present invention.

FIG. 12 is a cross-sectional view of the configuration of a portion in the vicinity of a pressing pad 32 in a fixing device 30 according to a fifth variation of the embodiment of the present invention.

Referring to FIG. 12, the pressing pad 32 further includes a cover 327 in the fifth variation. The fifth variation differs from the second or third variation in this respect. That is, the pressing pad 32 includes an outlet side member 322, an inlet side member 325, and the cover 327.

The cover 327 is continuously provided between a fixing belt 31 and the inlet side member 325 and between the fixing belt 31 the outlet side member 322. The cover 327 is in the form of a sheet. The cover 327 is fixed to an outer peripheral surface 325*a* of the inlet side member 325. An outer peripheral surface 327*a* of the cover 327 is in contact with the fixing belt 31. The inlet side member 325 and the outlet side member 322 press the fixing belt 31 via the cover 327.

As the inlet side member 325 is separated from the outlet side member 322 (in the case of a configuration as illustrated in the second variation), or the outer peripheral surface 325*a* of the inlet side member 325 is moved closer to a pressure roller 37 than an outer peripheral surface 322*a* of the outlet side member 322 (in the case of a configuration as illustrated in the third variation), a portion of the cover 327 in the vicinity of a rear end portion 327*b* shifts from a state where the portion extends above the upper surface of the outlet side member 322 (dotted line in FIG. 12) to a state where the portion is drawn into a space between the outlet side member 322 and the fixing belt 31 (solid line in FIG. 12). Meanwhile, as the inlet side member 325 approaches the outlet side member 322 (in the case of the configuration as illustrated in the second variation), or the outer peripheral surface 325*a* of the inlet side member 325 moves away from the pressure roller 37 toward the outer peripheral surface 322*a* of the outlet side member 322 (in the case of the configuration as illustrated in the third variation), the portion of the cover 327 in the vicinity of the rear end portion 327*b* shifts from the state where the portion is drawn into the space between the outlet side member 322 and the fixing belt 31 to the state where the portion extends above the upper surface of the outlet side member 322.

It should be noted that except for the above, the configurations of an image forming apparatus 1 and the fixing device 30 are the same as those in the second or third variation and thus, the description thereof will not be repeated.

According to the fifth variation, a boundary between the outer peripheral surface 325*a* of the inlet side member 325 and the outer peripheral surface 322*a* of the outlet side member 322 is covered with the cover 327. It is thus possible to prevent a local decrease in a nip pressure at the boundary between the inlet side member 325 and the outlet side member 322.

[Others]

The glossiness control unit of the present invention is not limited to the one that changes the curvature of the fixing belt within a predetermined range from the nip inlet as in the above-described embodiment and variations, as long as the glossiness control unit controls the glossiness of a toner image formed on a paper sheet by changing a shear force to be applied to the toner image formed on the paper sheet within the predetermined range from the nip inlet.

It is possible to confirm, by examining a fixed image, that the fixing device 30 controls the glossiness of a toner image formed on a paper sheet by changing a shear force to be applied to the toner image formed on the paper sheet. Specifically, when the glossiness of the toner image is low, the shear force applied to the toner image is small. Thus, the length of the fixed image along a paper sheet conveyance direction is small. Meanwhile, when the glossiness of the toner image is high, the shear force applied to the toner image is large. Thus, the length of the fixed image along the paper sheet conveyance direction is large.

A fixing device to which the present invention is applied may be the one using the direct-heating method, in which a belt is directly heated by a heater instead of being stretched around a heating roller, or may be the one using a heat generating sheet, as a heat source, based on the induction heating (IH) method or a thermal resistor.

It is possible to combine the above-described embodiment and variations as appropriate. For example, the above-described embodiment may be combined with the second variation and the third variation such that the inlet side member 321 and the camshaft 323 according to the above-described embodiment are movable in both of the direction along the conveying path TR and the direction along the pressing direction. Furthermore, the extending part 326 according to the fourth variation or the cover 327 according to the fourth variation may be applied to the above-described embodiment or the first variation.

Although embodiments and variations of the present invention have been described and illustrated in detail, the disclosed embodiments are made for purposes of illustration and example only and not limitation. The scope of the present invention should be interpreted by terms of the appended claims, and all changes which come within the meaning and range of equivalency of the claims are therefore intended to be embraced therein.

What is claimed is:

1. A fixing device for fixing a toner image on a paper sheet by conveying the paper sheet on which the toner image has been formed while holding the paper sheet at a fixing nip, the fixing device comprising:

an endless belt that rotates, the belt being provided on a side facing the toner image formed on the paper sheet;

a pressing member that is disposed on an inner side of the belt, and presses the belt from the inner side;

a pressure member that is disposed on an outer side of the belt, and forms the fixing nip between the pressure member and the belt by pressing, from the outer side of the belt, a portion of the belt pressed by the pressing member; and a controller that controls glossiness of the toner image formed on the paper sheet by changing a shear force to be applied to the toner image formed on the paper sheet within a predetermined range from a nip inlet that is an end of the fixing nip, located upstream in a direction in which the paper sheet is conveyed, wherein the controller changes a curvature of the belt within the predetermined range from the nip inlet.

2. The fixing device according to claim 1, wherein the controller changes the curvature of the belt within the predetermined range from the nip inlet by changing a shape of the pressing member.

3. The fixing device according to claim 2, wherein
the pressing member includes a first pressing member that presses the belt at the nip inlet, and
the controller changes at least one of a shape and a position of a portion of the first pressing member, which presses the belt.

4. The fixing device according to claim 3, wherein
the controller changes a curvature of the portion of the first pressing member, which presses the belt.

5. The fixing device according to claim 3, wherein
the controller changes a position of the first pressing member in a direction along the direction in which the paper sheet is conveyed.

6. The fixing device according to claim 3, wherein
the controller changes a position of the first pressing member in a direction along a pressing direction in which the first pressing member presses the belt.

7. The fixing device according to claim 3, wherein
the pressing member further includes a second pressing member that presses the belt at a downstream side with respect to a pressing position where the first pressing member presses the belt, in the direction in which the paper sheet is conveyed.

8. The fixing device according to claim 7, wherein
the pressing member further includes an extending part that is integrally formed with the second pressing member, the extending part extending from the second pressing member to a space between the belt and the first pressing member.

9. The fixing device according to claim 7, wherein
the pressing member further includes a cover continuously provided between the belt and the first and second pressing members.

10. The fixing device according to claim 1, further comprising:
a receptor that receives a setting on the fixing device,
wherein the curvature of the belt is changed based on at least one of a type of the paper sheet and the setting received by the receptor.

11. The fixing device according to claim 1, wherein
the belt includes:
a base material layer having a thickness of 60 μm to 80 μm inclusive;
an elastic layer that is provided on an outer peripheral side of the base material layer, and has a thickness of 200 μm to 1,200 μm inclusive; and
a surface layer that is provided on an outer peripheral side of the elastic layer and on an outermost surface of the belt, and has a thickness of 20 μm to 100 μm inclusive.

12. The fixing device according to claim 11, wherein
JIS-A hardness of the elastic layer is between 13° and 80° inclusive.

13. An image forming apparatus comprising:
an image forming part that forms a toner image on the paper sheet; and
the fixing device according to claim 1.

* * * * *